US005342164A

United States Patent [19]

Kinney et al.

[11] Patent Number: 5,342,164

[45] Date of Patent: Aug. 30, 1994

[54] WASTE COLLECTION METHOD

[75] Inventors: Russell C. Kinney; Donald C. Kinney, both of Hartland; Lyle Paullin, Oconomowoc; Richard Paullin, Hartland; Jeffrey W. Parrott, Pewaukee; Donald Smith, Oconomowoc, all of Wis.

[73] Assignee: Expert Disposal Service, Inc., Hartland, Wis.

[21] Appl. No.: 27,296

[22] Filed: Mar. 4, 1993

Related U.S. Application Data

[63] Continuation of Ser. No. 706,921, May 29, 1991, Pat. No. 5,252,020.

[51] Int. Cl.[5] ..... B65F 3/02

[52] U.S. Cl. ..... 414/786; 414/346; 414/408; 220/1.5

[58] Field of Search ..... 414/408, 409, 403, 404, 414/406, 407, 340, 343, 345, 346, 349, 350, 488, 786; 298/8 R, 17.5, 23 MD, 22 R, 17.6, 17.7; 220/1.5

[56] References Cited

U.S. PATENT DOCUMENTS

| | | | |
|---|---|---|---|
| 311,346 | 11/1963 | Harbers et al. . | |
| 3,809,267 | 5/1974 | Knight . | |
| 3,921,839 | 11/1975 | Herpich . | |
| 4,219,298 | 8/1980 | Stragier et al. | 414/409 |
| 4,242,953 | 1/1981 | Gelais | 100/100 |
| 4,310,279 | 1/1982 | Johnston | 414/408 |
| 4,597,710 | 7/1986 | Kovats | 414/409 |
| 4,830,436 | 5/1989 | Sockwell et al. | 298/8 |
| 4,840,531 | 6/1989 | Dinneen | 414/409 |
| 4,906,039 | 3/1990 | Broman | 296/37.6 |
| 4,915,570 | 4/1990 | Rath et al. | 414/409 |
| 5,015,142 | 5/1991 | Carson | 414/409 |

FOREIGN PATENT DOCUMENTS

| | | |
|---|---|---|
| 0405428 | 1/1991 | European Pat. Off. . |
| 682876 | 11/1952 | United Kingdom . |

OTHER PUBLICATIONS

Cushman Advertisement 1989.

Holden Industries, Inc., Advertisement, "Flexi-Dump E-Z Load" Jul.-Aug. 1988.

Bayne Machine Works, Inc. Advertisement "Thinline Preimum Lift System", admitted prior art.

Lodal, Inc. Advertisement, admitted prior art.

Jakel Advertisement "Shovelveyor", admitted prior art.

*Primary Examiner*—Frank E. Werner

*Attorney, Agent, or Firm*—Quarles & Brady

[57] ABSTRACT

A method of collecting mixed trash and recyclable waste separated from the mixed trash from several pick up locations and transporting the same to their respective delivery destinations. A conventional garbage truck and a recyclable waste collection vehicle are parked at a central location. A motorized satellite vehicle with a mixed trash bin and a recyclable waste bin is driven from one pick up location to another, and mixed trash and recyclable waste at the pick up locations are loaded manually into appropriate bins on the satellite vehicle. The satellite vehicle is driven to the parked garbage truck and the parked recyclable waste collection vehicle where the bins are unloaded. The garbage truck and the recyclable waste collection vehicle can be driven to final delivery destinations for the mixed trash and the recyclable waste, respectively. The method also contemplates using the bins of the satellite vehicle for collecting two segregated waste types. A parked recyclable waste collection vehicle with a container partitioned into two separate volumes can then be used to collect and transport the two segregated waste types.

8 Claims, 4 Drawing Sheets

FIG. 3
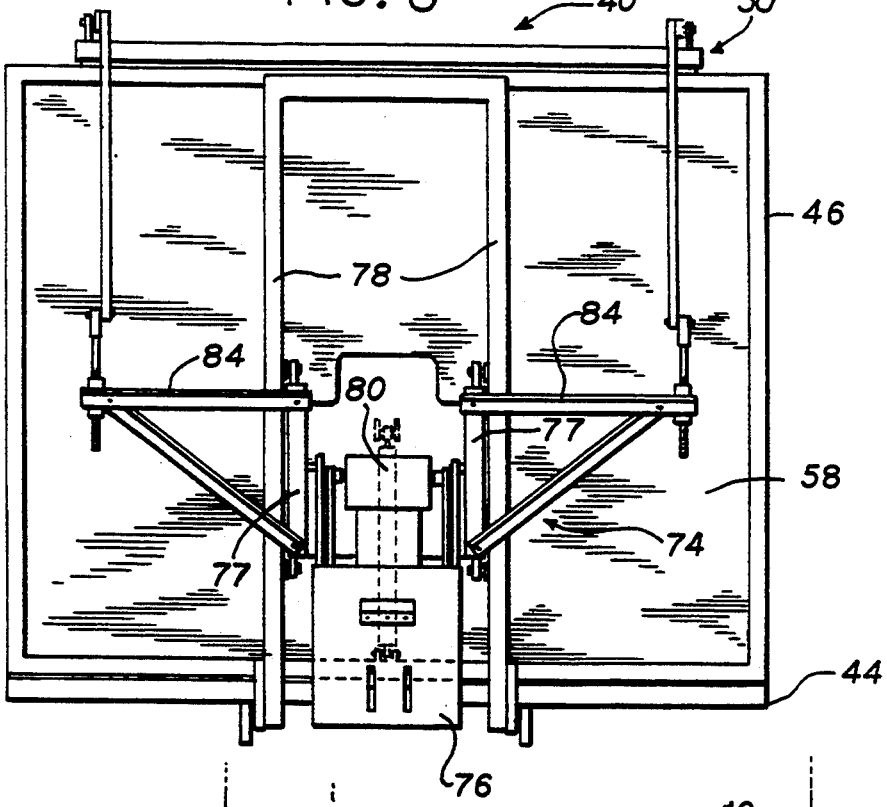
FIG. 4
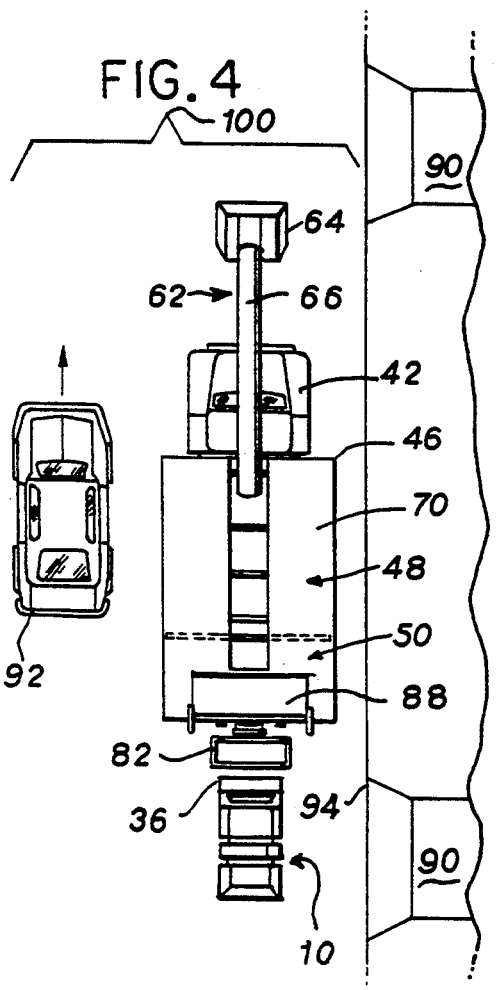
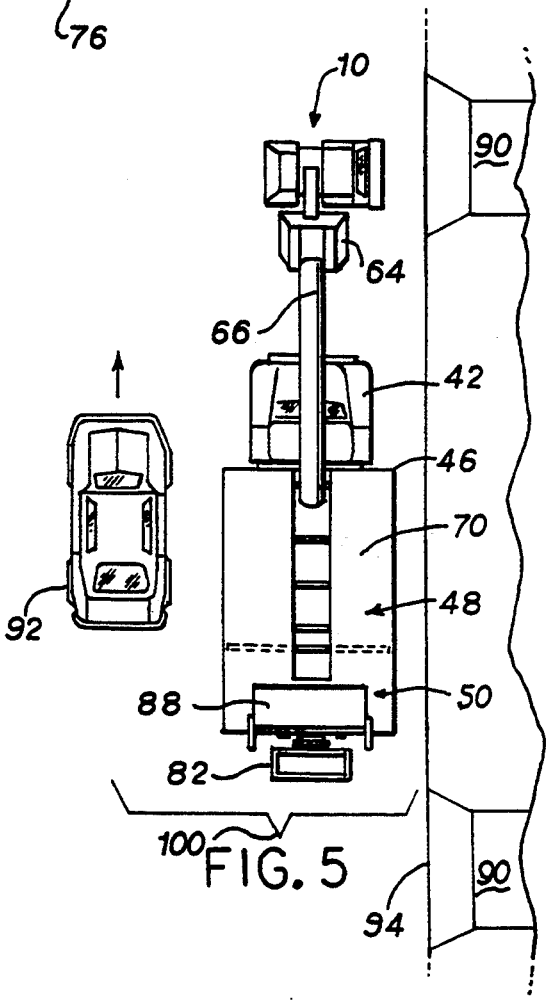
FIG. 5

FIG. 6
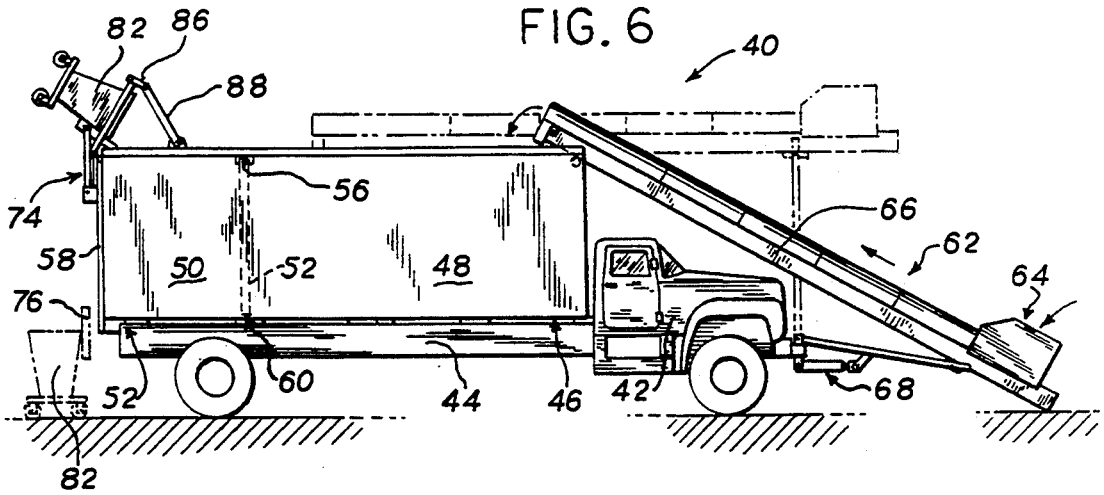
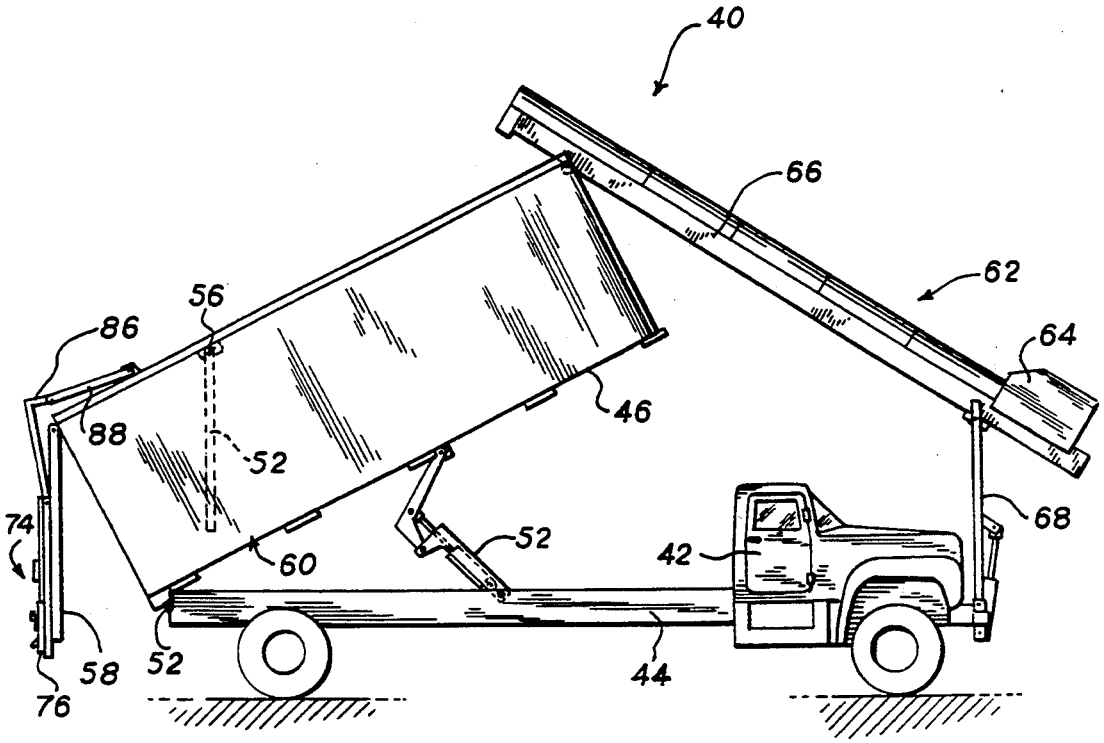
FIG. 7

WASTE COLLECTION METHOD

This is a continuation of application Ser. No. 07/706,921, filed on May 29, 1991.

FIELD OF THE INVENTION

The present invention relates to a method for collecting wastes and specifically to a method for efficiently collecting and segregating recyclable waste and non-recyclable waste.

BACKGROUND ART

As the amount of solid waste generated in the United States increases and landfill capacity diminishes, efficient recycling becomes of critical importance. In many communities, recyclable waste amounts to 40% of the total waste collected and yet is not allowed in landfills but must be transported to separate recycling facilities.

Despite the magnitude of the recycling problem, the economics of waste collection impose severe limits on the additional cost that may be tolerated in dealing with recyclable materials. Waste collection is characterized by frequent collection of small amounts of waste from many decentralized generators, typically homes, for removal to a remote disposal site. A high level of service, as expected by consumers, is possible largely because of the evolutionary optimization of waste handling methods: equipment and labor, over the years, have been carefully matched to task at hand.

The allocation of waste removal equipment has been improved by the use of large trucks having compaction capabilities extending their effective range and capacity between unloadings. Increased range and capacity eliminates unnecessary and costly trips between the customer/generators and the disposal site. The labor needed to collect waste has been minimized by designing these trucks for efficient operation by two or three man teams. Frequently, the trucks will include specialized hoists to lift trash containers into the truck. Such hoists are controlled from curbside, reducing wasted motion in the collection cycle.

A principle additional cost to the recycling of waste is the separation of the waste types. Although various procedures have been proposed for the separation of waste types at the disposal site, currently, the most cost effective separation method is to have recyclable waste separated by the customer/generator and to maintain that separation throughout the waste collection process.

The difficulty of maintaining a number of separated waste streams is monumental. The straightforward approach, of having separate vehicles and collection teams for each waste stream, increases the total cost of waste collection by the number of separate collections. The cost is increased further by the fact that with such separate collections, the average waste volume collected by each collection team is a smaller percentage of the waste generated by each household. Accordingly, the efficiencies of waste collection drop markedly.

SUMMARY OF THE INVENTION

The present invention provides a method for collecting multiple, segregated waste types without unduly increasing the amount of labor, time or equipment required. One central vehicle with a partitioned container or several central collection vehicles are loaded from one or more satellite vehicles, the latter having multiple bins to maintain the separation of the waste types. The satellite vehicles improve the productivity of the loading personnel and allow the central vehicles to be larger than would be possible if such vehicles were to travel directly to the waste collection points through alleyways and the like.

In one aspect, the present invention is a method for collecting mixed trash and recyclable waste, which is separated from the mixed trash, from several pick up locations and transporting the mixed trash and recyclable waste to final delivery destinations. The method includes parking a garbage truck having a mixed trash container and a recyclable waste collection vehicle having a recyclable waste container, preferably, on a street next to a curb. A motorized satellite vehicle is driven to one or more pick up locations where mixed trash and recyclable waste are located. The mixed trash is manually loaded into the mixed trash bin on the satellite vehicle and the recyclable waste is manually loaded into the recyclable waste bin on the satellite vehicle. When the driver feels it is time to empty the bins on the satellite vehicle, the motorized satellite vehicle is driven to the location of the parked garbage truck and the mixed trash is mechanically transferred from the mixed trash bin on the motorized satellite vehicle into the mixed trash container on the garbage truck. Likewise, the motorized satellite vehicle is driven to the location of the parked recyclable waste collection vehicle and recyclable waste is mechanically transferred from the recyclable waste bin on the motorized satellite vehicle into the recyclable waste container on the recyclable waste vehicle. The motorized satellite vehicle can be driven repeatedly between pick up locations and the garbage truck and the recyclable waste collection vehicle to collect mixed trash in the mixed trash container on the garbage truck, and recyclable waste in the recyclable waste containers on the recyclable waste collection vehicle. Mixed trash collected in the mixed trash container on the garbage truck can be transported to a final delivery destination for the mixed trash by driving the garbage truck to the final delivery destination for the mixed trash. Recyclable waste collected in the recyclable waste collection vehicle can be transported to a final delivery destination for the recyclable waste by driving the recyclable waste collection vehicle to the final delivery destination for recyclable waste.

In another aspect, the method of the present invention contemplates collecting at least two types of waste (each separated from one another) from several pick up locations and transporting them to final delivery destinations. In this aspect, the method involves parking a recyclable waste collection vehicle having a container partitioned into a first and second volume. A motorized satellite vehicle is driven to one or more pick up locations where a first and second waste type are located. The motorized satellite vehicle has a first bin which has a volume smaller than the first volume on the recyclable waste collection vehicle and a second bin which has a volume smaller than the second volume on the recyclable waste collection vehicle. When the motorized satellite vehicle reaches each pick up location, the first waste type is manually loaded into the first waste bin on the satellite vehicle and the second waste type is manually loaded into the second bin on the satellite vehicle. When the driver feels it is time to empty the bins on the motorized satellite vehicle, the satellite vehicle is driven to the parked recyclable waste collection vehicle where the first waste type is mechanically transferred from the first bin on the motorized satellite vehicle into the first volume of the partitioned container on the recyclable waste collection vehicle, and the second waste type is mechanically transferred from the second bin on the motorized satellite vehicle into the second volume of the partitioned container on the recyclable waste collection vehicle. The motorized satellite vehicle can be driven repeatedly between pick up locations and the recyclable waste collection vehicle to collect waste of the first type in the first volume of the partitioned container on the recyclable waste collection vehicle and waste of the second type in the second volume of the partitioned container on the recyclable waste collection vehicle. The first waste type can be transported to its delivery destination by driving the recyclable waste collection vehicle to the destination for the first waste type and dumping the first waste type from the first volume of the partitioned container. The second waste type can be transported to its delivery destination by driving the recyclable waste collection vehicle to the destination for the second waste type and dumping the second waste type from the second volume of the partitioned container.

In either aspect, the method contemplates additional optional steps needed to collect and transport additional segregated waste types located at the pick up locations.

It is one object of the invention to improve the efficiency of handling multiple segregated waste streams. The increased size of the central collection vehicles allowed by the satellite vehicles improves the effective range of collection even without compaction, such compaction which is rendered difficult by the segregation requirement of the waste streams. The capacity of the non-compacting recyclable waste collection vehicle can be enlarged because waste is preferably loaded into the recyclable waste collection truck by dumping waste into a waste receiving receptacle in front of the truck and transferring the waste over a passenger compartment on the truck and mechanically into the waste container. This allows the walls of the container to be very high.

It is another object of the invention to allow multiple small amounts of separate waste types to be simply loaded into the satellite vehicle, and yet to be easily unloaded in larger amounts to the central collection vehicle. Mechanical dumping of the bins on the satellite vehicle allows this objective to be achieved.

It is yet another object of the invention to reduce the additional time and labor required to handle segregated waste. The bins on the satellite vehicle may dump toward the rear and toward the curb side of the satellite vehicle. The satellite vehicle may thus unload its separated wastes by backing up to one garbage truck's rear and dumping its rear bin and then proceeding to dump its second bin at the front of the recyclable waste collection truck, and optionally, proceed to the rear of the recyclable waste collection truck to empty an optional front bin. Alternatively, the satellite vehicle can position itself in front of the recyclable waste collection truck and dump its first bin rearward, and position itself behind the truck and dump its second bin sideward. The selection of unloading directions permits the unloading to be accomplished with the flow of traffic in an efficient manner.

The foregoing and other objects and advantages of the invention will appear from the following description. In the description, reference is made to the accompanying drawings which form a part hereof, and in which there is shown by way of illustration, a preferred embodiment of the invention. Such embodiment does not necessarily represent the full scope of the invention, however.

BRIEF DESCRIPTION OF THE DRAWINGS

FIG. 3 is a detailed view of a rear door of the central collection vehicle showing a rear lift in a lowered position;

FIGS. 4 and 5 are plan views of the central collection vehicle being loaded by the satellite vehicle and showing the relative flow of traffic and the placement of the satellite vehicle for the unloading;

FIG. 6 is a side view of the central collection vehicle showing the rear lift in the dumping position, the front conveyor in the loading position and the container in the collection position;

FIG. 7 is a view similar to that of FIG. 6 showing the front conveyor in the transportation position and the container in the dumping position.

DETAILED DESCRIPTION OF THE PREFERRED EMBODIMENT

Figure 2:
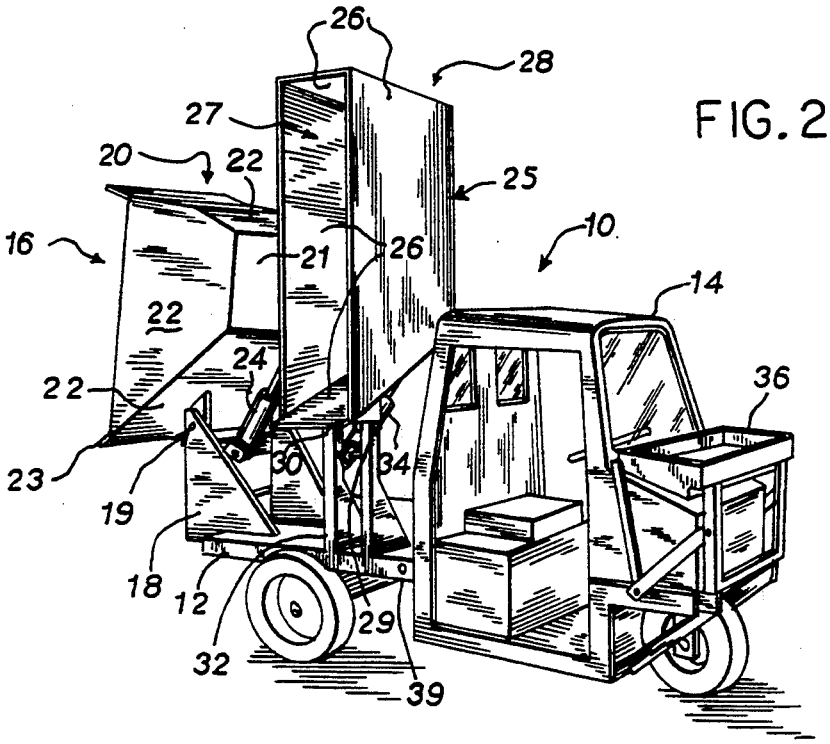
FIG. 2 is a perspective side view of a satellite collection vehicle showing a front and side bins in the dumping positions.

Referring to FIG. 2, a satellite collection vehicle 10 includes generally a driver's compartment 14 mounted at the front and a rear bed 12. The driver's compartment 14 houses a small gasoline engine or the like for propulsion of the satellite vehicle 10 along its longitudinal axis and a steering system, as is well understood in the art. A number of different vehicles suitable for use with the invention are manufactured by Cushman Inc., of Lincoln, Nebr.

A box-like rear bin 20, having a bottom 21 and four upstanding side walls 22, is held by the bed 12 and opens at a face 16 for receiving a first waste type, typically non-recyclable waste. The rear bin 20 is pivotally attached to the bed 12 by a hinge 19 having one hinge side fastened near a lip 23 of the rearmost sidewall 22 and the other hinge side attached to the top of an upstanding hinge support 18. The lower end of the hinge support 18 is affixed to the rear edge of the bed 12.

A hydraulic cylinder 24 extends between the hinge support 18 and a tie point (not shown), attached to the bottom 21 of the rear bin 20 so as to swing the rear bin 20 about the hinge 19 and between a first collection position (not shown in FIG. 2), in which the bottom 21 of the bin 20 is adjacent to the bed 12 and the face 16 opens vertically upward, and a second dumping position (shown in FIG. 2) in which the bottom 21 of the bin 20 swings away from the bed 12 under the influence of the hydraulic cylinder 24, and the upper face 16 opens horizontally rearward so that the contents of the rear bin 20 may be dumped over lip 23.

In the preferred embodiment, lip 23 extends horizontally sixty-six inches so as to be compatible with the seventy-two inch openings of conventional trash-compacting garbage trucks. The eight inch difference allows a margin of four inches on a side to permit the driver some error in aligning the two openings. Proper sizing between the lip 23 and the receiving opening of the truck prevents spilling of waste from the bin 20 and backwash of waste from the receiving truck. It will be understood that other dimensions may be used.

A box-like side bin 28, similar to rear bin 20, and having a bottom 25 and four upstanding side walls 26, is located between the rear bin 20 and the driver's compartment 14 and opens at a face 27 to receive a second waste type, typically recyclable materials having a lower average collection volume than the non-recyclable materials. The side bin 28 is pivotally attached to the bed 12 by a hinge 29, having one hinge side fastened near a lip 30 of the curb side sidewall 26 of side bin 28 and the other hinge side attached to the top of an upstanding hinge support 32 affixed along its lower end to the curb side of the bed 12. A second hydraulic cylinder 34 extends between the hinge support 32 and a tie point (not shown) attached to the bottom 25 of the side bin 28 to swing the side bin 28 between a first collection position (not shown in FIG. 2), in which the bottom 25 of the bin 28 is adjacent to the bed 12 and the face 27 opens vertically upward adjacent to the face 16 of the rear bin 20, when the rear bin 20 is likewise in the collection position, and a second dumping position in which the bottom 25 of the bin 28 swings away from the bed 12 under the influence of the hydraulic cylinder 34, and the face 27 opens horizontally sideways so that the contents may be dumped over lip 30 toward the curb side of the vehicle 10.

It will be understood that the curb side of the vehicle 10 is that side of the vehicle closest to the curb when the vehicle is observing the rules of travel on the roads and that the traffic side is opposite to the curb side. Likewise, the rear and front of the vehicle are those directions corresponding to the vehicle's normal motion.

The rear bin 20 may be constructed of welded 14 gauge sheet steel or of fiberglass according to well known methods.

The lip 30 of the side bin 28 is substantially narrower than the lip 23 of the rear bin 20, commensurate with the smaller volume of side bin 28 and to differentiate its waste type from that held in the rear bin 20, during the unloading process as will be described.

During loading of the satellite vehicle 10, the rear and side bins 20 and 28 will be in the collection position and the bins 20 and 28 may be filled by dropping the waste bundles into the upwardly open faces 16 and 27 of bins 20 and 28 as selected according to a visual determination of waste types or markings on the waste handle. A short screen 34 extends upward from the top of the frontmost sidewall 22 of the rear bin 20 to prevent spillage from one bin to the other, when both are full and in the collection position, but not to impede the convenient loading of the bins 20 and 28 by the driver from a number of angles about the vehicle 10. It must be remembered that each collected waste bundle is relatively small compared to the total volume of the bins 20 and 28, and hence the loading of the bins 20 and 28 may be readily accomplished by hand. Further, because two types of waste material may be loaded at once, the loading time is not appreciably longer than that which would be required for commingled recyclable and non-recyclable material.

Optionally, a third type of waste having lower volume than either the waste type of the rear bin 20 or of the side bin 28 may be collected in a nose bin 36 which is attached to the vehicle 10 in front of the driver compartment 14. This nose bin 36 does not pivot and dump and is intended for small amounts of specialty recyclable waste such as newspapers that are readily managed by hand or that justify additional manual effort.

The extension and retraction of the hydraulic cylinders 24 and 34 moving bins 20 and 28 are controlled by valves 38 (not shown) and 39. Valve 38 is positioned near the hinge support 18 on the traffic side of the vehicle 10. Valve 39 is located on the rear bed 12 between the driver compartment 14 and the hinge support 32 on the curb side of the vehicle 10. The placement of valves 38 and 39 not only reduces the possibility that the operator of the vehicle 10 will be in the way of traffic when dumping the bins 20 and 28, but also serves to improve the efficiency of the unloading process as will be described below.

Figure 1:
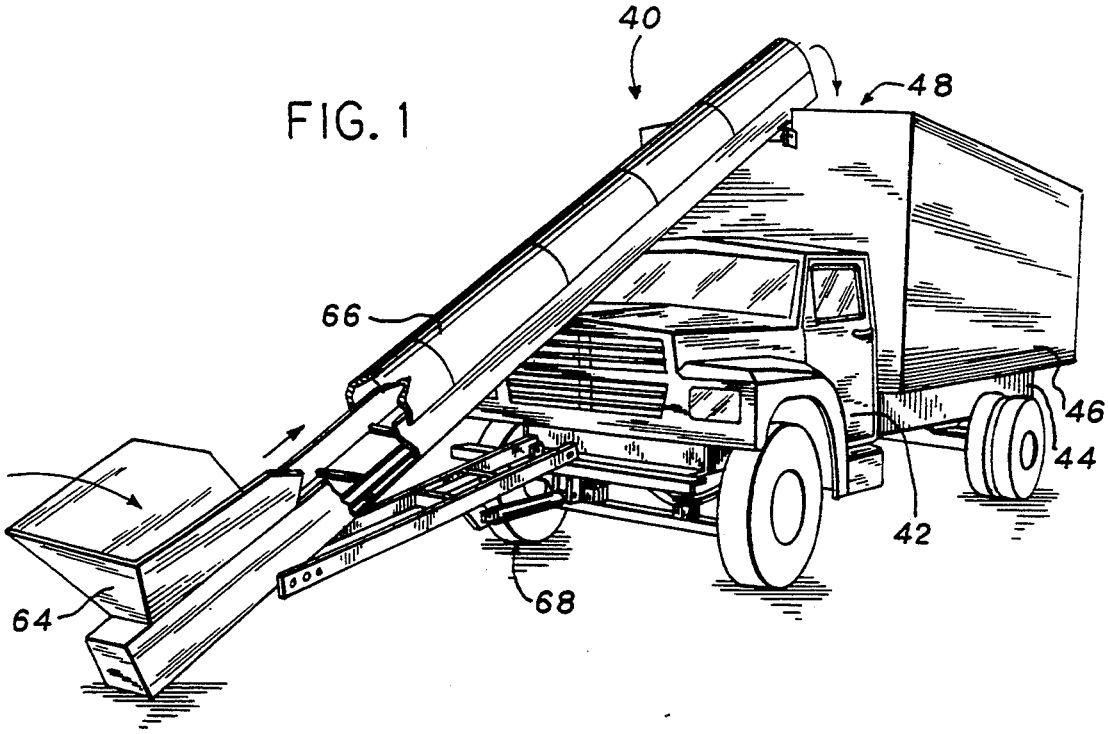
FIG. 1 is a perspective front view of a central collection vehicle showing a forward loading conveyor.

Referring to FIG. 1, a central collection truck 40 includes a cab 42 and bed 44, as is generally understood in-the art, for travel generally along a longitudinal axis. A box-like container 46 is supported by the bed 44 to receive the segregated wastes from the satellite waste collection vehicle 10. Referring to FIG. 6, the rear of the container 46 pivots, in the manner of the container of a dump truck on a hinge 52 at the rear of the bed 44, and may be raised about that hinge 52 by a hydraulic cylinder 54 between a collecting position and a dumping position as will be described.

When the container 46 is in the collecting position, the bottom of the container 46 rests against the bed 44 and a partition 52 divides the container 46 into a front section 48 and a rear section 50, the partition 52 hanging vertically from a hinge 56 from the top of the container 46. It will be appreciated that the relative size of the front section 48 and the rear section 50 may be adjusted by relocating the position of the partition 52, and that the volumes of those sections 48 and 50 may be adjusted to correspond with the relative volumes of waste types to be received by these sections.

A lock 60 at the lowermost edge of the partition 52 locks the partition 52 against motion about hinge 56 by securing the lower edge of the partition 52 to the bottom wall of the container 46. The rear wall of the container 46 is a door 58 which, like partition 52, hangs vertically from a hinge from the top rear edge of the container 46.

The front section 48 of the container 46 is loaded by means of a conveyer 62 having a hopper 64 at one end for receiving waste and a belt section 66 for carrying the waste type from the hopper 64 to the other end of the conveyor 62, as is generally understood in the art. In a loading position, the hopper 64, as shown in solid lines in FIG. 6, is positioned near the ground in front of the cab 42 for receiving waste from the side bin 28 of the satellite vehicle 10 (not shown in FIG. 6). The belt section 66 rises above the cab 42 of the truck 40 and the end of the conveyor 66 removed from the hopper 64 is positioned at the top of the container 46 over the front section 48 to drop the waste into the front section 48. For long distance movement of the truck 40, the conveyor 62 is lifted to a transportation position (shown in phantom in FIG. 6) by means of a hydraulic cylinder and lever 68 having one end attached to the front lower edge of cab 42 and the other end attached to the hopper 64 to lift the hopper 64 and to slide the entire conveyor 62 backwards until the belt section 66 is generally parallel to the ground above the cab 42 and container 48. At all times during the movement of the conveyer 62 between its loading and transportation positions, the end of the conveyor 62 removed from the hopper 64 is over the front section 48. Accordingly, the conveyer 62 may be moved between its two positions even while waste is being moved through the belt section 66 without waiting or concern for spilling or misdirecting waste. A commercially available conveyor suitable for use with the present invention is manufactured by Jakel Co. Inc., of Reeseville, Wis. under the name of Shovelveyor.

Referring to FIGS. 4 and 5, the front section 48 of the container 46 is covered by a top wall 70 having a slotted opening 71 centered over the longitudinal axis of the truck 40 to provide an opening for receiving waste from the conveyor 62 in any position of the conveyer but reducing the possible loss of the waste caused by wind or the like.

Referring again to FIG. 6, the rear section 50 of the container 46 may be loaded by means of a rear lift 74 mounted on the back surface of the rear door 58. Referring to FIG. 3, the rear lift 74 employs a carrier plate 76 attached to a trolley 77 which rides between tracks 78 attached to the rear door 58. The carrier plate 76 is lifted along tracks 78, from the bottom to the top of the container 46 by a reeving cylinder 80. A cart 82 (shown in FIG. 6) may be hung on the carrier plate 76 to receive waste from the satellite vehicle 10 and to lift the waste and dump the waste into the rear section 50.

Referring still to FIG. 3, the top edge of the carrier plate 76 is pivotably mounted on the trolley 77 so that when the carrier plate 76 is at the top edge of the container 46, a tipping cylinder (not shown) will cause the carrier plate 76 to tip upward and outward from the trolley 77 and the rear door 58 of the container 48 and to dump the contents of the cart 82 into the rear section 50 over the top of the container 46 . An assembly for holding and tipping a cart 82 or the like and suitable for the present invention is commercially available from D&B Fluid Inc., Hutchinson, Kans. as model DBB500.

Wings 84, attached to the trolley 77 and extending outward toward the left and right side of the truck 40 are attached at their outer ends to upwardly extending levers 86 which engage a swinging lid 88 placed over the rear section 50. When the trolley 77 rises with a load of waste, the levers 86 are pushed upward by the wings 84 and serve to open the swinging lid 88 over the rear section 50 to permit the waste to be dropped into that section 50 and yet to prevent the escape of waste during other times.

Referring to FIG. 7, the container 46 may be emptied rapidly, yet still preserving the segregation of the waste in the front and rear sections 48 and 50, by tipping the container 46 upward on hinge 52 so that the bottom of container 46 is slopped downward toward the rear of the truck 40 and the force of gravity acts to pull the waste in the front and rear sections 48 and 50 toward the rear door 58. The rear door 58 swings open to permit the rear section 50 to be emptied through the rear door 58, but the partition 52 is kept locked by lock 60 to prevent the front section 48 from being emptied. Once the rear section 50 is emptied, the truck 40 may be repositioned and the partition 52 released to empty the front section 48.

Figure 8:
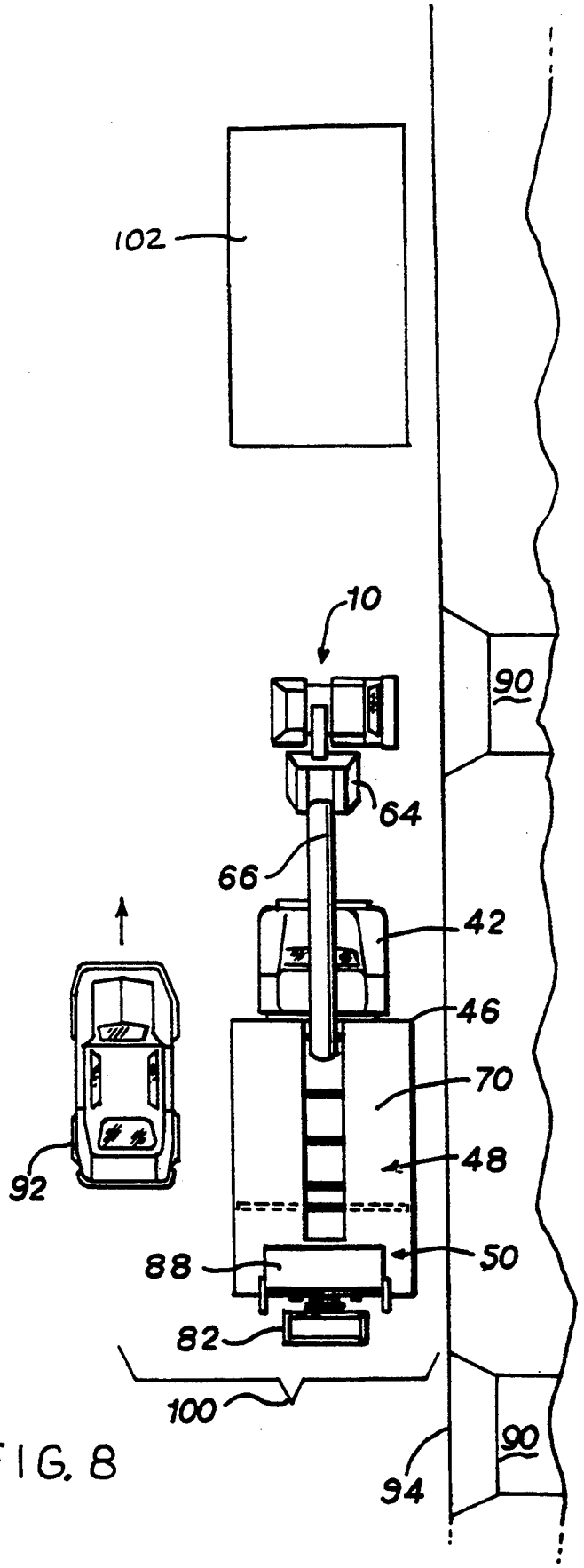
FIG. 8 is a plan view similar to FIG. 5 showing a conventional garbage truck in addition to the plan shown in FIG. 5.

Referring to FIGS. 4, 5 and 8, the satellite vehicle 10 unloads its bins of segregated waste 20 and 28 to the collection truck 40 and a conventional compacting garbage truck 102 positioned between alleys or side streets 90 positioned on a main street 100 by traveling generally with traffic 92 but next to the curb 94 to position its nose bin 36 near the cart 82 for unloading. The satellite vehicle 10 then travels to the front of the collection truck 40, still with the flow of traffic 92 and turns toward the curb 94 in front of the collection truck 40 to dump its side bin 28 into the hopper 64. Either before or after unloading to the collection truck 40, the satellite vehicle 10 may back up to the rear of the conventional garbage truck 102 for unloading non-recyclable waste from its rear bin 20. During all unloading operations, the satellite collection vehicle 10 is out of the line of oncoming traffic 92.

In certain situations, it is not desirable to use a conventional garbage truck 102 in addition to a recyclable waste collection truck 40. In these situations, it may be desirable to load a first waste type into the side bin 28 on the satellite vehicle 10 and a second waste type into the rear bin 20 on the satellite vehicle 10. The satellite vehicle 10 can be driven to the rear of the recyclable waste collection truck 40 to unload the first waste type in the side bin 28 into the rear section 50 of container 46 of the truck 40. The satellite vehicle 10 can be driven to the front of the collection truck 40 to unload the second waste type in the rear bin 28 into the front section 48 of the container 46 on the truck 40.

Many modifications and variations of the preferred embodiment which will still be within the spirit and scope of the invention will be apparent to those with ordinary skill in the art. For example, means other than the conveyor lift may be used for loading the front section and rear sections of the box. In order to apprise the public of the various embodiments that may fall within the scope of the invention, the following claims are made.

We claim:

1. A method for collecting mixed trash and recyclable waste separated from the mixed trash from several pick up locations and transporting the mixed trash and recyclable waste to final delivery destinations, the method comprising the steps of:

a) parking a garbage truck having a mixed trash container;

b) parking a recyclable waste collection vehicle having a recyclable waste container;

c) driving a motorized satellite vehicle to one or more pick up locations, the motorized satellite vehicle having a mixed trash bin with a volume smaller than the mixed trash container on the garbage truck and a recyclable waste bin with a volume smaller than the recyclable waste container on the recyclable waste collection vehicle;

d) manually loading mixed trash at each pick up location into the mixed trash bin, and recyclable waste at each pick up location into the recyclable waste bin;

e) driving the motorized satellite vehicle to the parked garbage truck, and mechanically transferring mixed trash from the mixed trash bin on the satellite vehicle into the mixed trash container on the garbage truck;

f) driving the motorized satellite vehicle to the parked recyclable waste collection vehicle, and mechanically transferring recyclable waste from the recyclable waste bin on the satellite vehicle into the recyclable waste container on the recyclable waste collection vehicle;

g) repeating steps c) through f) to collect mixed trash in the mixed trash container on the garbage truck and recyclable waste in the recyclable waste container on the recyclable waste collection vehicle;

h) transporting mixed trash collected in the mixed trash container on the garbage truck to a final delivery destination for the mixed trash by driving the garbage truck to the final delivery destination for the mixed trash; and i) transporting recyclable waste collected in the recyclable waste collection vehicle to a final delivery destination for the recyclable waste by driving the recyclable waste vehicle to the final delivery destination for the recyclable waste.

2. A method as recited in claim 1 wherein:

the motorized satellite vehicle is backed up to a rear of the garbage truck before mixed trash in the mixed trash bin on the satellite vehicle is transferred into the mixed trash container on the garbage truck; and the mixed trash is mechanically transferred from the mixed trash bin on the motorized satellite vehicle by mechanically dumping the mixed trash bin rearward.

3. A method as recited in claim 1 wherein:

the motorized satellite vehicle is positioned in front of the recyclable waste collection vehicle substantially out of a flow of traffic before recyclable waste in the recyclable waste bin is transferred into the recyclable waste container on the recyclable waste collection vehicle; and the recyclable waste is mechanically transferred from the recyclable waste bin on the motorized satellite vehicle by mechanically dumping the recyclable waste bin sideward.

4. A method as in claim 3 wherein:

an additional type of recyclable waste which is separated from the mixed trash and the other recyclable waste is manually loaded onto the motorized satellite vehicle at each pick up location; and the motorized satellite vehicle is positioned to a rear of the recyclable waste collection vehicle substantially out of the flow of traffic to transfer the additional recyclable waste on the motorized satellite vehicle into an additional recyclable waste container on the recyclable waste collection vehicle.

5. A method as recited in claim 1 wherein recyclable waste is transferred from the recyclable waste bin on the motorized satellite vehicle into the recyclable waste container on the recyclable waste collection vehicle by:

mechanically dumping the recyclable waste from the recyclable waste bin on the motorized satellite vehicle into a recyclable waste receiving means located in front of the recyclable waste collection vehicle; and transferring the recyclable waste received by the recyclable waste receiving means over a passenger compartment on the recyclable waste collection vehicle and into the recyclable waste container on the recyclable waste collection vehicle.

6. A method for collecting at least two types of waste separated from one another from several pick up locations and transporting the separated waste to final delivery destinations, the method comprising the steps of:

a) parking a recyclable waste collection vehicle, the vehicle having a container partitioned into a first and a second volume;

b) driving a motorized satellite vehicle to one or more pick up locations, the motorized satellite vehicle having a first and second bin where the first bin has a volume smaller than the first volume on the recyclable waste collection vehicle and the second bin has a volume smaller than the second volume on the recyclable waste collection vehicle;

c) manually loading waste of a first type located at each pick up location into the first waste bin on the motorized satellite vehicle, and waste of a second type at each pick up location into the second bin on the motorized satellite vehicle;

d) driving the motorized satellite vehicle to the parked recyclable waste collection vehicle, and mechanically transferring waste of the first type from the first bin on the satellite vehicle into the first volume of the partitioned container on the recyclable waste collection vehicle, and mechanically transferring waste of the second type from the second bin on the satellite vehicle into the second volume of the partitioned container on the recyclable waste collection vehicle;

e) repeating steps b) through d) to collect waste of the first type in the first volume of the partitioned container on the recyclable waste collection vehicle and waste of the second type in the second volume of the partitioned container on the recyclable waste collection vehicle;

f) transporting the first waste type to a delivery destination for the first waste type by driving the recyclable waste collection vehicle to the delivery destination for the first waste type and dumping the first waste type from the first volume of the partitioned container; and g) transporting the second waste type to a delivery destination for the second waste type by driving the recyclable waste collection vehicle to the delivery destination for the second waste type and dumping the second waste type from the second volume of the partitioned container.

7. A method as recited in claim 6 wherein:

the motorized satellite vehicle is positioned in front of the recyclable waste collection vehicle substantially out of the flow of traffic before waste of the first type in the first bin on the satellite vehicle is transferred into the first volume of the partitioned container on the recyclable waste collection vehicle, and the waste of the first type is mechanically transferred from the first bin on the motorized satellite vehicle by mechanically dumping the first bin rearward; and the motorized satellite vehicle is positioned to the rear of the recyclable waste collection vehicle substantially out of the flow of traffic before waste of the second type in the second bin on the satellite vehicle is transferred into the second volume of the partitioned container on the recyclable waste collection vehicle, and the waste of the second type is mechanically transferred from the second bin on the satellite vehicle by mechanically dumping the second bin sideward.

8. A method as recited in claim 6 wherein waste of the first type is transferred from the first bin on the satellite vehicle into the first volume of the partitioned container on the recyclable waste collection vehicle by:

mechanically dumping the recyclable waste from the first bin into a waste receiving means located in front of the recyclable waste collection vehicle; and transferring waste of the first type received by the recyclable waste receiving means over a passenger compartment on the recyclable waste collection truck and into the first volume of the partitioned container on the recyclable waste collection vehicle.

* * * * *